United States Patent [19]

Stimmel

[11] Patent Number: 4,886,239

[45] Date of Patent: Dec. 12, 1989

[54] ICE CUBE MAKER

[76] Inventor: Stephanie J. Stimmel, 14 Feller Dr., Central Islip, N.Y. 11722

[21] Appl. No.: 97,126

[22] Filed: Sep. 16, 1987

[51] Int. Cl.[4] ..... F25C 1/24

[52] U.S. Cl. ..... 249/117; 206/504; 206/509; 220/23.4; 220/22; 220/339; 220/94 A; 249/121; 249/129

[58] Field of Search ..... 249/119, 120, 121, 126, 249/127, 128, 129, 131, 117; 220/23.4, 23.83, 22, 339, 94 A; 206/504, 508, 509

[56] References Cited

U.S. PATENT DOCUMENTS

| | | | |
|---|---|---|---|
| 3,157,447 | 11/1964 | Devery et al. | 384/416 |
| 3,381,875 | 5/1968 | Tunick | 220/22 |
| 3,391,816 | 7/1968 | Swett | 220/22 |
| 3,394,861 | 7/1968 | Truax | 220/22 |
| 3,401,827 | 9/1968 | Messina | 220/94 A |
| 3,458,113 | 7/1969 | Swartzbaugh | 220/339 |
| 3,485,416 | 12/1969 | Fohrman | 220/339 |
| 3,823,972 | 7/1974 | Ramer | 220/23.4 |
| 4,133,445 | 1/1979 | Mandelbaum | 220/23.4 |
| 4,428,497 | 1/1984 | Julius et al. | 220/339 |
| 4,627,550 | 2/1986 | Dines | 220/94 A |

FOREIGN PATENT DOCUMENTS

| | | | |
|---|---|---|---|
| 527238 | 5/1955 | Italy | 220/23.4 |
| 846602 | 8/1960 | United Kingdom | 220/23.4 |

OTHER PUBLICATIONS

"Let Shell Help Design Your Package of Tomorrow with Durable Integral Hinges of Polypropylene", *Modern Packaging,* Nov. 1963, pp. 14 and 15.

*Primary Examiner*—James Housel
*Attorney, Agent, or Firm*—Edward H. Loveman

[57] ABSTRACT

This ice cube maker is an ice cube molding cup or container with closed sides and bottom, and open top closed by a hinged cover on which is a flat, flexible handle. The cover is secured in place by quickly engageable and disengageable catch members. Lateral quick attachment and detachment members permit a multiplicity of cups to be arranged in a planar array. Cups of different sizes and shapes may be laterally attached in the planar array. The cups may have internal partitions defining chambers to make more than one ice cube in each cup.

8 Claims, 4 Drawing Sheets

ICE CUBE MAKER

The term "ice cube" as used herein denotes a small piece or block of ice of any geometrical shape.

The term "ice" as used herein denotes any fluid such as water, fruit juice, ice cream mix, or other liquid food products, frozen to solid form.

BACKGROUND OF THE INVENTION

1. Field of the Invention

This invention relates to the art of molds for forming ice cubes in freezers and freezer compartments of refrigerators, and more particularly concerns novel closed cups or containers for forming ice cubes individually.

2. Description of the Prior Art

Conventional freezer trays currently in general use for molding ice cubes in domestic refrigerators and freezers, are made of flexible plastic material. The usual tray has a matrix or array of fourteen cavities arranged in seven rows, with two cavities in each row to define two, side-by-side, columns. The tray is open at the top, and this causes a number of difficulties. The surface of the liquid being frozen is exposed to ambient air before and after the tray is placed in the freezer. The liquid, thus, picks up odors and foreign matter which contaminate the ice cubes. When the cubes are frozen, they are usually removed by twisting the tray in an upside down position to release the cubes. The cubes fall out of the open tray into a sink or onto a table or counter or even onto the floor in a disorderly array. If it is desired to pack one, two or more cubes in a lunch box, the cubes must be individually wrapped in metal foil or in a plastic wrap. This is time consuming, tedious, and difficult to do because the loose cubes are slippery, wet, frigid, and hard to handle. Another disadvantage is that the liquid of the melting cubes leaks through the wrappers into the lunch box, which is most undesirable.

It has been proposed, as described in U.S. Pat. Nos. 2,166,560 and 2,367,098, to provide a wire rack into which a multiplicity of separate cups with open tops can be placed in a freezer to freeze the liquid into individual cubes. These proposed expedients have as many disadvantages as the plastic trays with open tops currently in use. The wire racks are pliable and frequently twist out of shape so that the cups cannot be inserted. The racks have preformed frames so that only special cups of predetermined size and shape may be used. The cups either have no covers, or have loose covers, which easily fall off leaving the liquid to be frozen and the frozen cubes open to contamination by foreign matter.

SUMMARY OF THE INVENTION

The present invention is directed at overcoming the abovementioned, and other difficulties and disadvantages of currently known devices for molding ice cubes individually or in a matrix or array, in domestic freezers; and at the same time the invention provides novel, improved ice cube makers which have greater versatility and utility, with advantages over prior ice cube makers. According to the invention there is provided a multiplicity of cups or containers each having closed sides, top, and bottom. The top is a flat panel hinged to one of the side walls with a releasable catch provided to hold the top in closed positon. A flat, flexible handle is provided on the top to facilitate opening the cup and to help in carrying the closed cup. The cups may be inserted in any conventional suitable tray or rack for placement into a freezer. However, the cups are provided with means for detachably securing them to each other quickly to define a matrix or array of cups, so that the tray or wire rack is not needed and can be dispensed with. After the array of cups is filled with liquid and the covers are closed, the entire matrix or array may be placed into a freezer and left there until the liquid is frozen and the cubes are formed. Then any desired number of closed, covered cups may be quickly detached from the array and put into a lunch box without requiring supplemental wrapping as required heretofore. The array is not limited to making fourteen cubes at a time as in conventional ice cube trays, but the number of cubes can be larger or smaller depending on the number of frozen cubes desired. Further according to the invention, the cups can have cavities of different shapes, with or without partitions, so that cubes of different sizes and shapes can be made.

The cups can have the same or different shapes and sizes, but they will all have similar quick attachment said detachment means and covers so that all cups can be assembled quickly in an array for simultaneously freezing the liquid in all cups.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENTS

Figure 1:
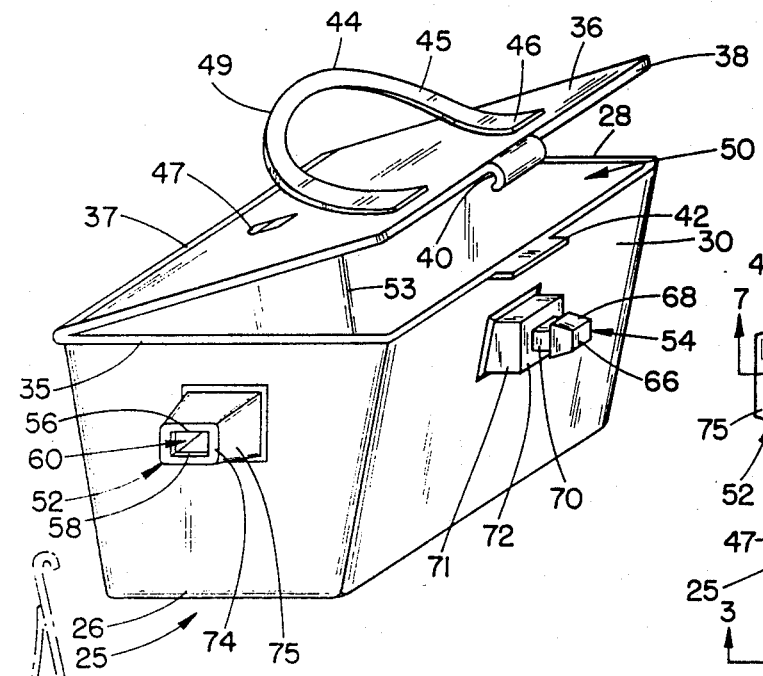
FIG. 1 is a perspective view of an ice cube molding cup or container embodying the invention, the cup being shown with partially open cover and partially raised handle.
Figure 2:
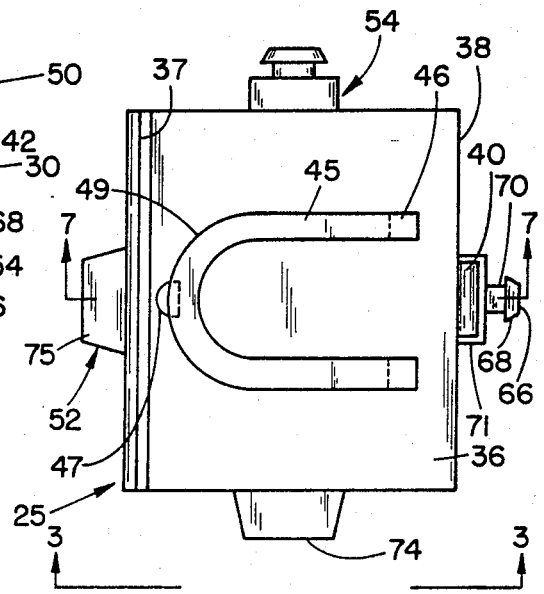
FIG. 2 is a top plan view of the cup of FIG. 1, shown with cover closed and handle released and retracted.
Figure 3:
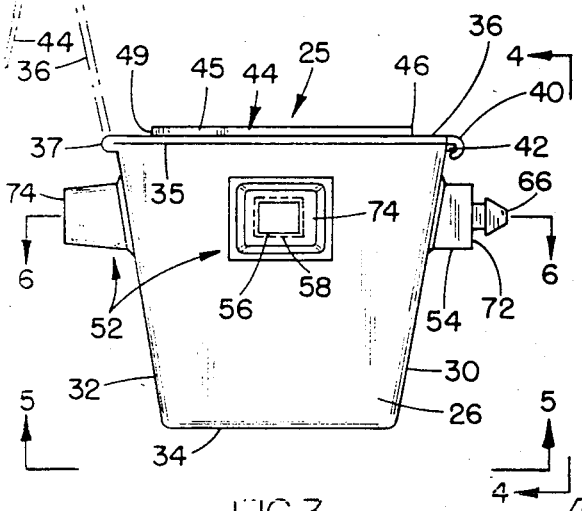
FIG. 3 is an end elevational view taken along line 3—3 of FIG. 2.
Figure 4:
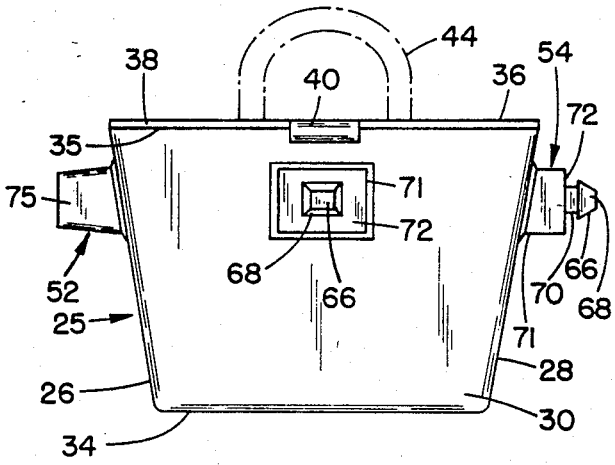
FIG. 4 is a front elevational view taken along line 4—4 of FIG. 3.
Figure 5:
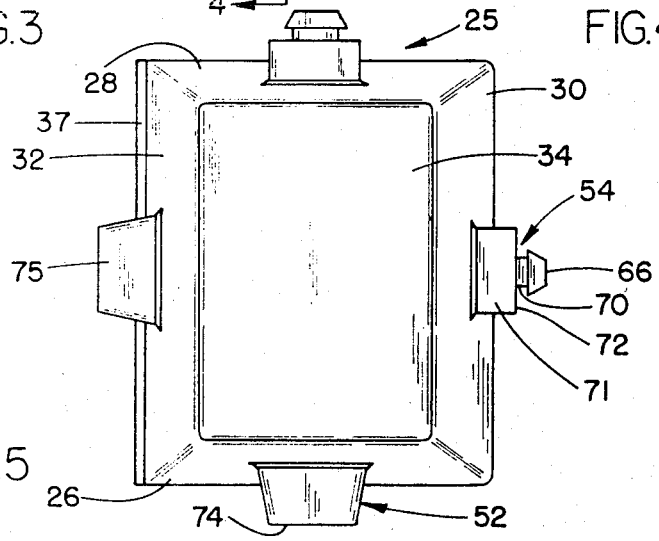
FIG. 5 is a bottom plan view taken along line 5—5 of FIG. 3.
Figure 6:
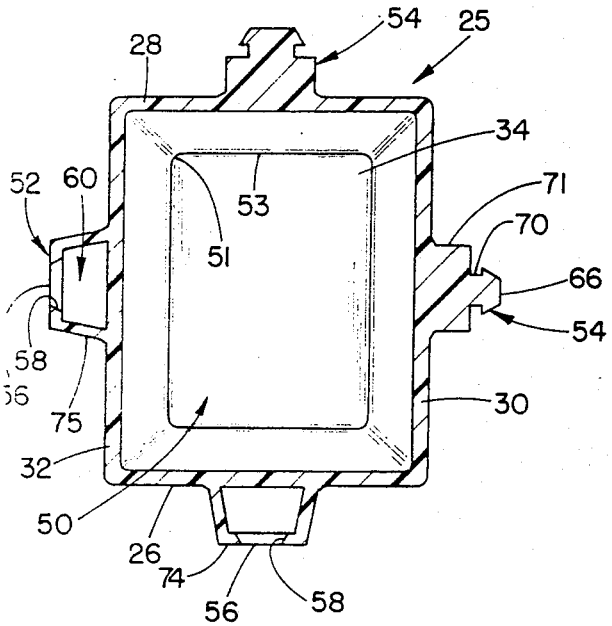
FIG. 6 is a horizontal cross sectional view taken along line 6—6 of FIG. 3.
Figure 7:
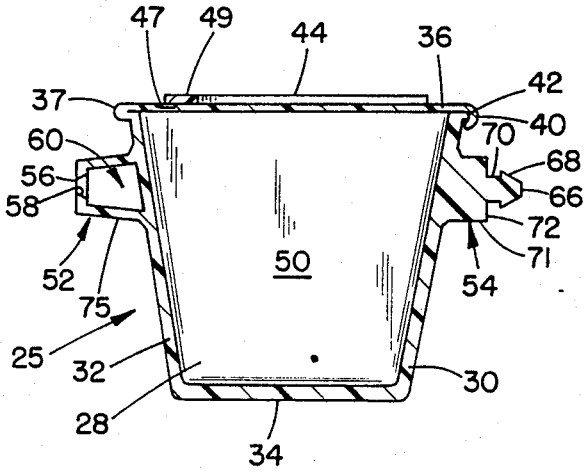
FIG. 7 is a vertical sectional view taken on line 7—7 of FIG. 2.

Referring now to the drawings wherein like reference characters designate like or corresponding parts throughout, there is illustrated in FIGS. 1–8, an ice cube molding cup or container generally designated by reference numeral 25 having a truncated pyramidal body defined by flat end walls 26, 28; front wall 30, back wall 32, bottom wall 34, and an open top 35. The top 35 is closed by a flat panel or cover 36 secured to the back wall 32 by an integral hinge 37 extending the full length of the cover 36. At a forward edge 38, the cover 36 is provided with a projecting curved catch or tongue 40 which detachably engages a central lip 42 projecting outwardly of the front wall 30. On the top of the cover 36 is a flat, flexible, U-shaped handle 44 having a pair of legs 45 with respective ends 46 secured to the cover 36. The handle ends 46 may be secured by electronic welding, fusing, cement bonding or other suitable means. A notch 47 in the cover 36 near the hinge 37 enable insertion of a fingernail under the free curved end 49 of the handle to facilitate raising it to the flexed position shown in FIGS. 1 and 4. If desired the handle 44 may be set in a U-shaped recess in the top of the cover so that the handle will lie absolutely flush with the top surface of the cover 36.

The ice cube molding cup or container 25 is made entirely of flexible plastic material such as polyethylene, polyvinyl, or the like. It will be noted that all the flexible walls 26, 28, 30, 32 and 34 are generally rectangular, or preferably trapezoidal in shape. Thus, the cavity or chamber 50 (FIG. 6) in the ice cube molding cup 25 is widest and longest at the top 35 and tapers downwardly to minimum rectangular area at the bottom 34. All inside corners 51 and edges 53 are rounded or curved to facilitate release of an ice cube made in the cavity 50 of the cup 25.

Figure 8:
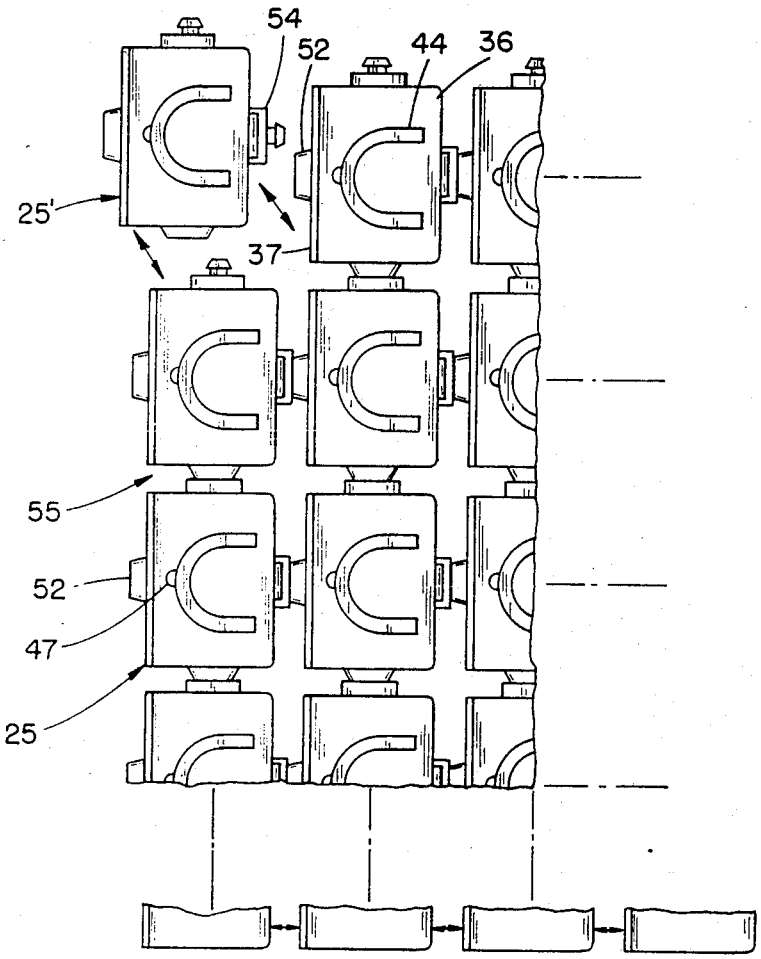
FIG. 8 is a top plan view of a matrix of covered cups according to the invention.

On the outer sides of the walls of the cup 25 are provided quick attachment and detachment members 52, 54, by means of which a multiplicity of cups may be quickly attached to each other in lateral engagement to form a planar matrix or array 55 as illustrated in FIG. 8. The array 55 of cups 25 may have any desired length and width with more than two cups in a row, more than seven rows, and more than two columns of cups if desired, or there may be an unequal number of cups in the several rows and columns.

The attachment and detachment means is comprised of two sockets 52 on adjacent end and back walls 26, 32. Each of the sockets 52 is rectangular in vertical section taken parallel to end and back walls 26, 32, and have a noncircular opening 56 with beveled edges 58 and an enlarged cavity 60.

The attachment and detachment means further includes two noncircular plugs 54, one located on the front wall 30 and the other located on the end wall 28. Each plug 54 has a rectangular head 66 with four beveled edges 68 to enable the plug head to be snapped beyond the socket opening 56 into the cavity 60. The beveled edges 58 of the socket opening 56 enable the plug head 66 to be snapped out from the socket 56 when required. Behind each plug head 66 is a neck 70 which engages inside edges 58 of the socket 52. Each neck 70 is integral with a base block 71 which has a front surface 72 that abuts a front rectangular frame-like side 74 of the socket 52 when the plug head 66 is engaged in the socket 56. Since the sockets 52 have external side walls 75 which are all flexible, the plugs 54 may be quickly attached to the sockets 52 of adjacent ice cube molding cups 25 to form the planar matrix or array 55 as shown in FIG. 8. Any one or more cups 25 may be readily detached from the matrix 55 or reattached thereto as indicated by detached cup 25' in FIG. 8.

Figure 12:
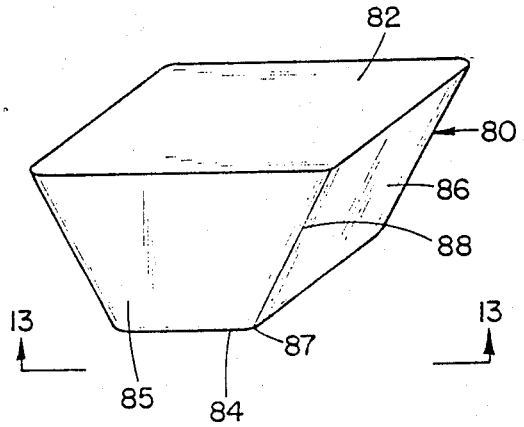
FIGS. 12, 14, 16 and 18 are oblique perspective views showing the forms of ice cubes made by employing the molding cups of FIGS. 1, 9, 10, and 11 respectively.
Figure 13:
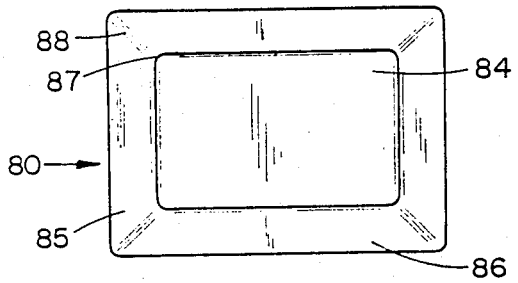
FIGS. 13, 15, 17 and 19 are bottom plan views taken along lines 13—13, 15—15, 17—17, and 19—19 of the ice cubes in FIGS. 12, 14, 16, and 18 respectively.
Figure 14:
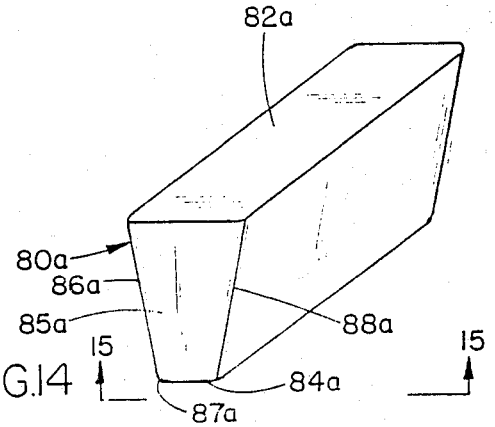

FIGS. 12 and 14 show a form of ice cube 80, **80*a*, which may be molded by the ice cube molding cup 25 and have a rectangular top 82, a flat rectangular bottom 84 which is smaller than the top 82, and a pair of tapered trapezoidal sides 85, 86. The ice cube is generally frustopyramidal in form with rounded corners 87 and edges 88. This tapered form of ice cube is easily ejected or removed from the molding cup 25. By pushing up on flexible bottom wall 34 while the cover 36 is open in the dotted line position shown in FIG. 3, the ice cube 80 will be thrust upwardly out of the cup 25. If desired, hot water may be run onto the inverted cup 25 while the cover 36 is closed. This will melt the seal of ice to the inner walls of the cup 25 and the ice cube 80 will drop out of the cavity 50 when the cover 36 is opened. The catch members 40, 42 hold the cover 36 securely closed until they are manually disengaged. The handle 44 may be lifted as shown by solid lines in FIG. 1 and dotted lines in FIGS. 3 and 4 to facilitate opening the cover 36. The handle 44 may be used when the cover 36 is closed for carrying the cup 25. The outwardly projecting sockets 52 and the plugs 54 may be used as hand or finger grips for holding the cup 25 when the cover 36 is being opened and the ice cube 80** is being removed.

Figure 9:
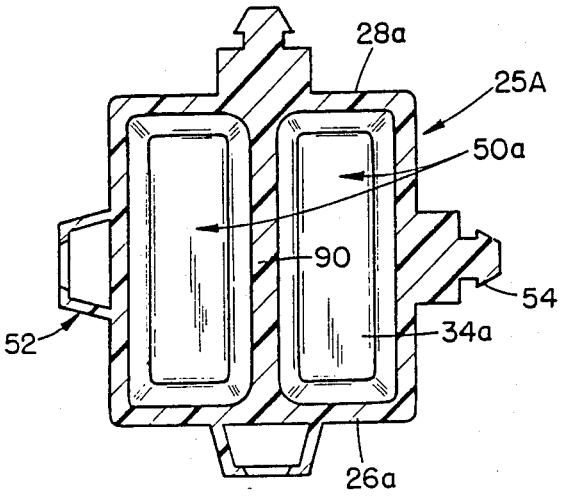
FIGS. 9, 10 and 11 are cross sectional views similar to FIG. 3, of three other ice cubes molding cups having internal cavities of different shapes.
Figure 15:
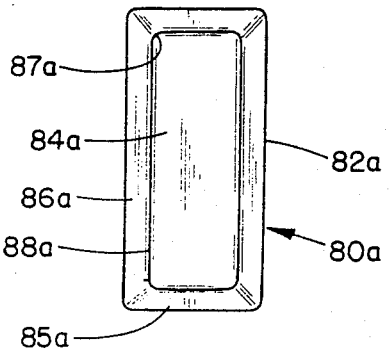

FIG. 9 shows an ice cube molding up or container 25A which is similar to the molding cup 25 except that a central partition 90 is integrally joined to opposite walls **26*a*, 28*a* to the interior of the cup 25 into two chambers 50*a* each of which is less than one half the size of the cavity 50 in the cup 25. FIGS. 14 and 15 show the wedge shaped form of ice cube 80*a* made in the cup 25A. Two of these cubes 80*a* may be formed at a time in each cup 25A. The wedge shaped form of the cube 80*a* with tapered sides 85*a*, 86*a* has a wider rectangular top 82*a* with rounded corners 87*a* and a narrower rectangular bottom 84*a* also with rounded corners. The cube 80*a* has rounded edges 88*a*. These wedge shaped cubes 80*a* will easily be ejected from the cup 25A by pushing up on the flexible bottom wall 34*a***.

Figure 10:
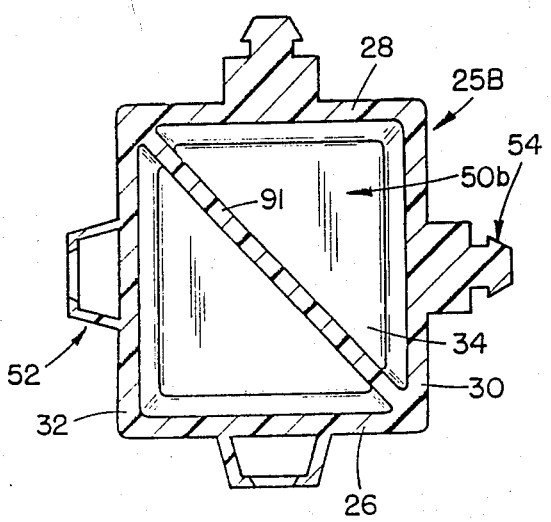
Figure 16:
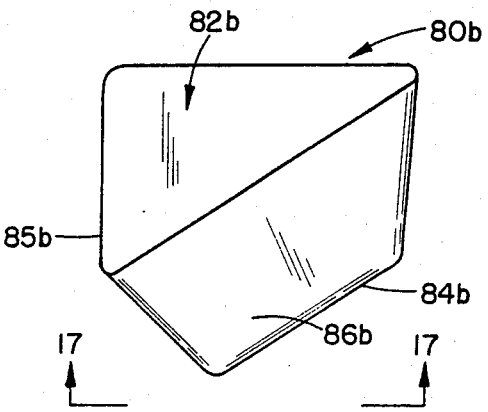
Figure 17:
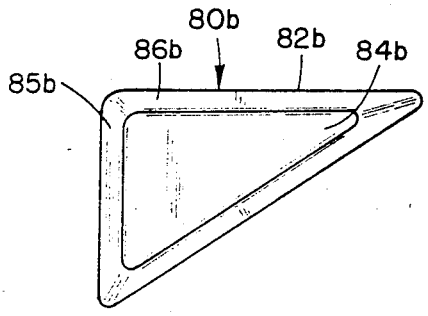

In FIG. 10 show another ice cube molding cup 25B with a diagonally placed partition 91 defining two chambers **50*b*. This form of construction produces the triangular truncated pyramidal form of ice cube 80*b* shown in FIGS. 16 and 17. Each of the two ice cubes formed in cup 25B will have a flat larger top 82*b* and a smaller bottom 84*b* with tapering side walls 85*b*, 86*b***.

Figure 11:
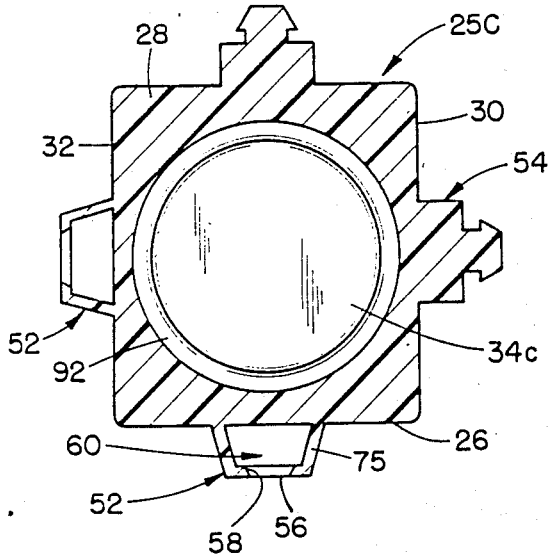
Figure 18:
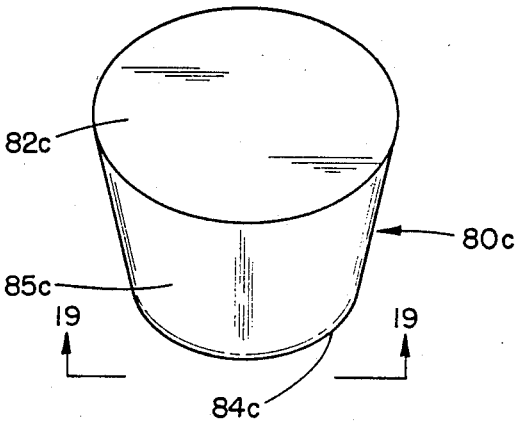
Figure 19:
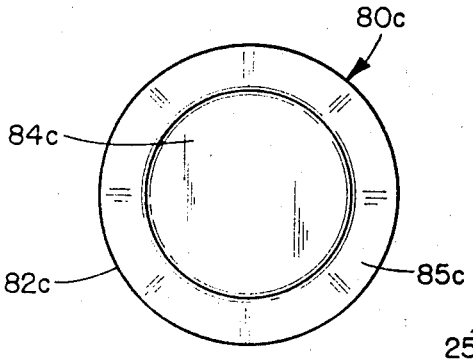

In FIG. 11 there is shown a further form of ice cube molding cup 25C which is externally truncated pyramidal in shape with flat sides as shown in FIGS. 1–8. However the interior of the cup 25C is formed with a conical wall 92 tapering downwardly to a bottom wall **34*c*. A conical form of an ice cube 80*c* made with the cup 25C is shown in FIGS. 18 and 19. A wall 92 may be made circular or elliptical in cross section so that a tapering wall 85*c* of the cube 80*c* will have no flat sides. The cube 80*c* has a circular top and bottom sides 82*c*, 84*c***. This form of ice cube may be preferred when a beverage is served in a round glass, and it is desired to have a cylindrical or conical ice cube rather than a rectangular square, or truncated pyramidal one.

Figure 20:
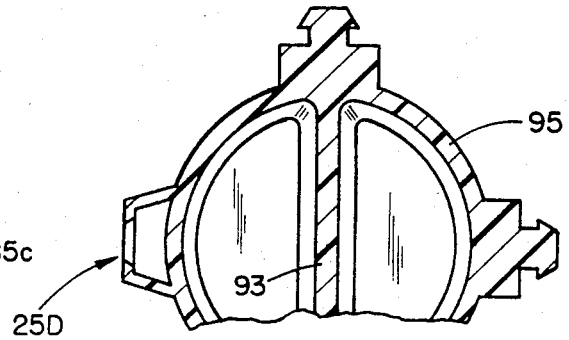
FIG. 20 is a fragmentary cross sectional view similar to portions of FIG. 6 showing another form of ice cube molding cup.

It is not necessary that the sides of the ice cube molding cup be flat like the walls 26, 28, 30, 32. Thus, as shown in FIG. 20, the side walls 95 of the cup 25D are cylindrically or preferably conically curved. If desired, a central partition 93 can be provided in the cup. This construction will provide semi-conical ice cubes which are about one half the size of the conical ice cube **80*c* shown in FIGS. 18 and 19**.

If desired, the partitions 90, 91, and 93 may be placed off center so that two ice cubes of different sizes may be made in each cup so partitioned.

In all forms of the ice cube molding cups shown in FIGS. 6, 9, 10, 11, and 20, two plug 54 and socket 52 pairs are provided at opposite sides. Thus, any desired number of ice cube molding cups having different external shapes and differently shaped internal cavities may be secured together to form a planar array or matrix. Since the plugs 54 and the sockets 52 are noncircular, the cups will not rotate with respect to each other. Instead of being rectangular in vertical section the sockets and plugs may have other noncircular shapes such as triangular, hexagonal, etc . . . . In all forms of plugs and sockets, they will be quickly attachable to and detachable from adjacent cups. It will be noted that the array of cups is not limited to fourteen in number in contrast with current conventional plastic ice cube trays which have fourteen cavities. More or less than fourteen ice cube molding cups may be provided in an array. Furthermore since the handles 44 lie flat, a plurality of planar arrays of ice cube molding cups 25, 25A–25D, may be stacked in a pile with more cups so more ice cubes are obtained than with conventional plastic ice cube trays. For example, three arrays 55 of ice cube molding cups embodying the present invention may contain twenty or more molding cups each to produce sixty or more ice cubes from a stack three layers high. Three stacked conventional ice cube trays will produce not more than forty-two ice cubes. Furthermore, the ice cubes produced by the present invention may have different sizes and shapes in any combination as desired, while in a stack of conventional identical ice cube trays will produce ice cubes of only one size and shape.

The present invention makes it possible to dispense with conventional ice cube trays altogether, since the ice cube molding cups are self-sustaining in planar array and need no supporting racks. This is a great convenience and makes it possible to fit an array of molding cups in a small or awkward, slanted position where a conventional ice cube tray will not fit. It will also be noted that conventional ice cube trays must be kept horizontal for the liquid to remain in the tray while freezing. This horizontal position is of course preferred also with the present invention, but it is not absolutely necessary, since the closed covers will keep the liquid in a slanted or tilted array of cups while freezing. The tightly fitting covers will keep also the liquid in the cups while the ice cubes melt after the cups are removed from the freezer. Thus, if one or more closed cups containing ice cubes, are placed in a lunch box, liquid will not leak out to wet adjacent food, napkins, etc . . . while the cubes melt. If desired, the individual cups containing liquid or frozen cubes can be returned to the freezer detached from each other. This is a great convenience since the cups containing ice cubes can be stored in the freezer in any available space. The covers will of course remain tightly closed at all times except when the ice cubes are being removed or have been removed, to prevent leakage of liquid and to prevent contamination of the ice cubes by debris, foreign material, odorous food, etc . . . .

The ice cube molding cups as described can be made by conventional mass production plastic molding processes at low cost. The individual cups can be so inexpensive that they are expendable and can be thrown away after one use, however their construction is very rugged and durable so that the cups can be washed and reused numerous times.

It should be understood that the foregoing relates to only a limited number of preferred embodiments of the invention which have been only by way of example only, and that it is intended to cover all changes and modifications of the example of the invention herein chosen for the purpose of the disclosure, which do not constitute departures from the spirit and scope of the invention.

What is claimed is:

1. An ice cube molding container, comprising:

an inverted, truncated pyramidal shaped body having closed opposing side walls, closed bottom wall, and an open top;

a cover hinged to one of said side walls to close said open top;

catch means disengageably holding said cover closed in leakproof abutment with said open top;

handle means on said cover to facilitate opening said cover;

said body having a conical internal cavity for forming a conical ice cube therein; and quick attachment and detachment means on said side walls to enable quick mutual lateral attachment of a multiplicity of said ice molding containers to each other to form a planar array, and to enable individual quick detachment of each of said containers from said array.

2. An ice cube molding container as defined in claim 1, wherein said handle means is a flat member bonded at one end to said cover and free at another end thereof for lifting with respect to said cover.

3. An ice cube molding container as defined in claim 1, wherein each catch means are mutually engaging elements on said cover and at least one other one of said side walls.

4. An ice cube molding container as defined in claim 1, wherein said quick attachment means comprises two plugs each located on an adjacent one of said side walls, and two sockets each located on an adjacent other one of said side walls of said body.

5. An ice cube molding container as defined in claim 4, wherein said plugs and sockets are non-circular in vertical section so that mutually attached containers are held nonrotatably in said array.

6. An ice cube molding container as defined in claim 1, further comprising a partition in said cavity dividing said cavity into two chambers for molding two conical ice cubes in said two chambers respectively.

7. An ice cube molding container as defined in claim 6, wherein said partition is centrally located between said opposing side walls.

8. An ice cube molding container as defned in claim 6, wherein said partition is diagonally located between said opposing side walls.

* * * * *